United States Patent [19]

Pepper et al.

[11] Patent Number: 4,526,770

[45] Date of Patent: Jul. 2, 1985

[54] METHOD OF PRODUCING CARBON FIBER AND PRODUCT THEREOF

[75] Inventors: Roger T. Pepper, Scarborough; Daniel C. Nelson, Old Orchard Beach, both of Me.; Douglas S. Lewing, New York, N.Y.

[73] Assignee: Fiber Materials, Inc., Biddeford, Me.

[21] Appl. No.: 384,881

[22] Filed: Jun. 4, 1982

Related U.S. Application Data

[63] Continuation-in-part of Ser. No. 193,120, Oct. 2, 1980, abandoned.

[51] Int. Cl.[3] ..... D01F 9/22

[52] U.S. Cl. ..... 423/447.4; 423/447.1; 423/447.2; 423/448; 264/29.2

[58] Field of Search ..... 423/447.1, 447.2, 447.4, 423/447.6, 448; 264/29.2; 8/115.5

[56] References Cited

U.S. PATENT DOCUMENTS

| | | | |
|---|---|---|---|
| 3,656,904 | 4/1972 | Ram | 423/447.7 |
| 4,002,426 | 1/1977 | Chenevey et al. | 264/29.2 |
| 4,073,870 | 2/1978 | Saji et al. | 423/447.6 |
| 4,100,004 | 7/1978 | Moss et al. | 423/447.6 |
| 4,113,847 | 9/1978 | Fukushima et al. | 423/447.6 |
| 4,347,279 | 8/1982 | Saji et al. | 423/447.6 X |

FOREIGN PATENT DOCUMENTS

| | | | |
|---|---|---|---|
| 2338357 | 2/1974 | Fed. Rep. of Germany | 423/447.3 |
| 49-00527 | 1/1974 | Japan | 423/447.1 |

*Primary Examiner*—William R. Dixon, Jr.
*Assistant Examiner*—Steven Capella
*Attorney, Agent, or Firm*—Schiller & Pandiscio

[57] ABSTRACT

A novel process is provided for the formation of improved carbonized fibrous materials with increased modulus of elasticity and strength as well as decreased diameter. Preferably, the precursor material is acrylonitrile, typically copolymerized with a minor amount of an acrylic monomer such as methyl acrylate. Drawing of the polymer fiber during oxidation is effected at an elevated temperature in the presence of a carboxylic acid (other than formic acid), or its anhydride, within the fiber. It is believed that the acid and/or its anhydride which is formed at the oxidizing temperature serves as a plasticizer and reduces the fiber yield stress and increases fiber plasticity so that the fibers may be drawn by as much as 300% or more in the presence of the acid and/or its anhydride during oxidation, thereby providing the desired improvement in increased modulus of elasticity and tensile strength of carbon fibers formed subsequently by carbonization of the oxidized fibers.

14 Claims, 2 Drawing Figures

METHOD OF PRODUCING CARBON FIBER AND PRODUCT THEREOF

Figure 1:
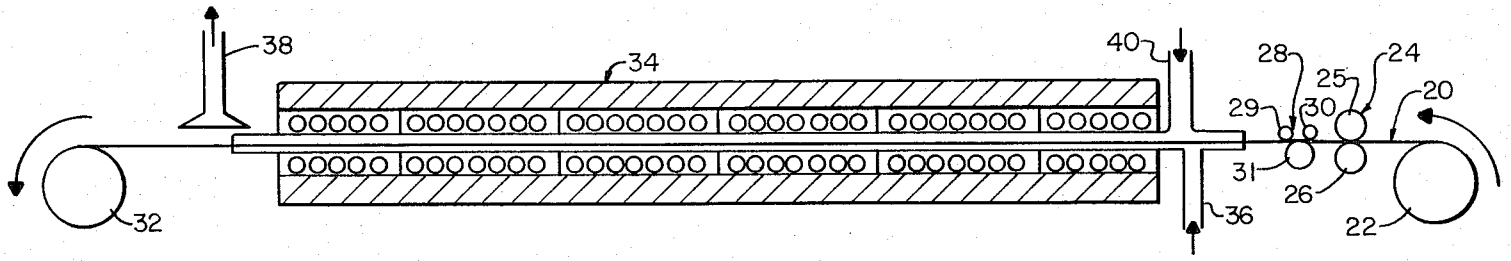

This application is a continuation-in-part of copending application Ser. No. 06/193,120 filed Oct. 2, 1980, now abandoned.

The present invention relates to polyacrylonitrile (PAN) fibers and particularly improved oxidized PAN fibers and the carbonized and graphitized forms thereof.

Polyacrylonitrile (—$CH_2CH(CN)$—) constitutes a major component of many industrial textile fibers or filaments. Oxidized PAN fiber is potentially useful to form heat protective fabrics as a substitute for asbestos. Carbonized and graphitized polyacrylonitrile (PAN) fibers form composites with other materials, particularly where high strength-to-density and high modulus-to-density ratios are desired. However, such applications are limited by the ultimate strength, modulus of elasticity and diameter of the carbonized and graphitized PAN fibers. Thus, it is not surprising that many attempts have been made to increase strength and elastic modulus and reduce the diameter of PAN fibers.

Particularly, the smaller the diameter of the carbonized or graphitized fiber, the greater is the ratio of surface area of the fiber to either weight or volume. The greater ratio thus provides increased fiber-to-matrix interface area, distributing the loading on the composite over a greater area so as to improve interlaminar shear strength markedly for composite materials utilizing such smaller diameter fibers. Additionally, smaller diameter fibers of improved strength are considerably more flexible than larger diameter fibers of similar strength, permitting formation of desirably thin woven fabrics or even braided and knitted fabrics, as composite precursors.

Present methods for the production of PAN-based carbon fibers call for the spinning of the PAN, followed by oxidation and carbonization of the resulting PAN fibers. The acrylonitrile monomer can be made by several known methods including direct catalytic addition of hydrogen cyanide to acetylene or the addition of HCN to ethylene oxide to give ethylene cyanohydrin, followed by dehydration. Polymerization is usually carried out in an aqueous solution with the polymer precipitating from the sytem as a fine white powder.

Pure polyacrylonitrile is difficult to spin because it is not sufficiently soluble in many organic solvents, and its fibers are is not readily dyed. Consequently, polymers other than a pure PAN homopolymer are usually produced commercially. Thus, a "PAN" fiber may actually be an acrylic polymer formed primarily of recurring acrylonitrile units copolymerized with a minor proportion of methyl methacrylate, vinyl pyridine, vinyl chloride and the like. These copolymers exhibit many properties substantially similar to an acrylonitrile homopolymer. By convention, if the fiber does not contain more than about 15 percent foreign material, it is referred to as polyacrylonitrile, and if more than 15% then as modified acrylonitrile. Examples of such copolymers include PAN fibers produced under trade names such as Orlon (E.I. DuPont de Nemours), Courtelle SAF (Courtaulds Ltd.) and Acrilan (Chemstrand).

The conversion of PAN to fibers may be accomplished by either dry or wet spinning, which produces the fiber as a continuous filament in either case. In the latter, a salt solution of the polymer is extruded through a spinneret into a liquid which can coagulate the PAN.

In the dry spinning process, a continuous filament is formed by the evaporation of a volatile solvent from a PAN solution extruded into a stream of hot gas. In either case the filaments are subsequently stretched to several times their original length at a slightly elevated temperature, for example 100° C., to draw out and align the main polymer chains and increase interchain adhesion, while reducing the fiber diameter. U.S. Pat. No. 3,729,549 teaches that the PAN fibers are sometimes oriented by hot drawing over a heated shoe at a draw ratio of about 3:1 to about 7:1. In one instance, stretching PAN fibers some fourteen times reportedly produced a fiber with respective Young's modulus and strength of $2.7\times10^6$ psi and $130\times10^3$ psi.

The denier of the resulting PAN fibers, such as those used as precursors for oxidation and carbonization, generally measures from 1.0 to 3. The spinning and production of PAN fiber precursors with a denier of less than 1.0 has proven impractical, since such fibers have been heretofore too fragile for normal textile processing.

To effect conversion of the PAN fibers to carbon fibers, the PAN fibers are heated to about 220° C. while exposed to oxygen or oxygen-containing gases such as air, nitrous oxide and sulphur dioxide. The heating encourages the formation of a ladder structure through a cyclization reaction, some of the $CH_2$ groups being oxidized and HCN being evolved. This may be ideally summarized as:

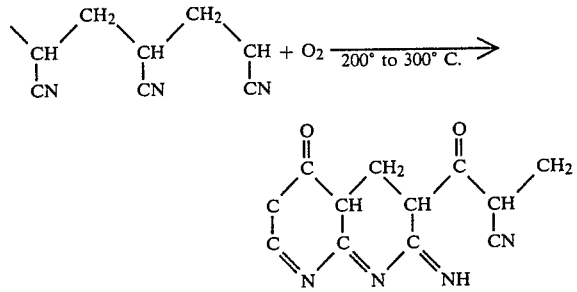

Some references in the prior art indicate that PAN fibers should be prevented from shrinking, or drawn slightly, during oxidation, in order to restrain the PAN filaments from reverting to their weak unstretched state. However, U.S. Pat. No. 4,100,004 issued to Moss et al indicates that some fibers (not identified as to source) may generally be stretched by at least 50%, though no experimental values greater than 50% are revealed and stretching of the fibers is generally limited to resulting carbonized fiber diameters of 6 microns or more. The maximum amount of stretching indicated by the prior art, (i.e. the prior limit of elongation during oxidation) which is the maximum strain-to-failure by rupture, is approximately 95%. Cf. W. Watt, Carbon, Vol. 10, pp 130–143 (1972), particularly at page 132. Through the process of the present invention, the PAN fiber is treated so that during oxidation it can be stretched at least double, i.e. beyond that prior art limit of elongation before rupture occurs. However, even a slight amount of stretching during oxidation has heretofore generally been avoided. In fact, general industrial practise has been to allow the fibers or filaments to shrink slightly during oxidation in order to avoid any damage to the fibers at this stage during large scale processing.

The PAN fibers may be further oxidized at higher temperatures up to about 300° C. Thereafter, to effect carbonization, the oxidized PAN fibers are heated to temperatures of 300° C. to 800° C. in a nonoxidizing atmosphere, such as nitrogen, argon, helium or hydrogen. During this stage, HCN and other products from the decomposition reaction of PAN are also released as gases. This release is accompanied by the build-up in the fiber of ribbons consisting largely of carbon atoms arranged in aromatic ring structures.

The strength and modulus of these carbonized fibers increases rapidly up to about 1400° C. However, while further heating beyond about 1400° C. continues to increase the elastic modulus, it reduces tensile strength, apparently because the structure of the carbonized fibers becomes more representative of true graphite. Consequently, commercial fibers are usually offered in a carbonized form with low modulus and high strength, or in graphitized form with high modulus and low strength. In one case, for example, heating PAN fibers from about 1400° C. to about 2400° C. reportedly resulted in a decrease in strength from approximately 3.1 $GN/m^2$ ($4.48\times10^5$ psi) to 2.2 $GNB/m^2$ ($3.2\times10^5$ psi), but an increase in the modulus from about 320 $GN/m^2$ ($33.4\times10^6$ psi) to 500 $GN/m^2$ ($72.5\times10^6$ psi).

From the foregoing, it can be seen that restrictions on the size of precursor fiber employed and the amount to which the fibers can be stretched during oxidation, place limits on the strength and modulus as well as the diameter of the resulting oxidized, carbonized or graphitized fibers produced. Additionally, in view of the relatively high temperatures involved, high inputs of energy are required to obtain an oxidized PAN, carbon or graphitized fiber of a given modulus of elasticity.

As earlier noted, a primary use for such graphitized or carbonized fibers or filaments is in composite materials wherein the fibers are embedded in a matrix, typically of another polymer or metal. The prior art appreciated that the strength of such composites could be enhanced with smaller diameter graphite fibers because they tend to exhibit increased tensile strength with reduction in diameter, and the increased ratio of surface area to volume provides better filament bonding. A need for a process capable of producing such small graphite filaments has been apparent for several years. For example, the aircraft industry currently has established a requirement for 2% strain-to-failure graphite fiber for use in civilian aircraft parts. A fiber having such a high strain-to-failure ratio would produce a composite of very high impact strength and toughness when embedded in a matrix, for example, of epoxy resin. A $30\times10^6$ psi modulus graphite filament (typical of prior art filaments of diameters greater than 6 microns) would be required to have a tensile strength of about 600,000 psi in order to meet the 2% strain to failure requirement. It is believed that no prior art process using the usual oxidation, carbonization and graphitizing steps on PAN precursor fibers is capable of producing graphite fibers of less than 6.0 microns in diameter and having this combination of high modulus and high tensile strength, although the demand for such is undeniable and has been well-known in the industry for several years. U.K. Pat. No. 1,311,817 teaches etching carbon fiber with water vapor during the carbonization process to produce fine fibers, the smallest exemplary diameter being about 4.5 microns. As is well established, however, the strongest and stiffest part of a carbon fiber is in the outer layers where the structure is better oriented than the fiber core, so the etching process tends to weaken the fiber considerably.

Accordingly, a primary object of the present invention is to provide an improved fiber and method of making the same.

Another object of the present invention is to provide an improved oxidized PAN, carbon or graphite fiber as well as a process for producing the same.

Yet another object of the present invention is to provide an oxidized PAN, carbon or graphite fiber with increased tensile strength and modulus of elasticity.

Still another object of the instant invention is to provide an oxidized PAN, carbon or graphite fiber of reduced cross-sectional area.

A more specific object of the present invention is to provide an improved process for making carbon and graphite fibers derived from acrylic polymers consisting primarily of recurring acrylonitrile units.

Yet another object of the present invention is to provide an improved process whereby smaller denier oxidized PAN fibers can be employed in the production of carbon and graphite fibers.

Other objects of the present invention are to provide an improved process for making carbon or graphite fibers wherein a precursor fiber consisting primarily of recurring acrylonitrile units, is oxidized and stretched during such oxidation; to provide carbon fibers of increased thermal stability exhibiting enhanced molecular structure; to provide an improved process for the formation of stabilized fibrous materials derived from acrylic polymers resulting in a product which is suitable for carbonization, or carbonization and graphitization; and to provide a carbon or graphite fiber derived from an acrylic polymer, which carbon fiber retains desirable textile properties (e.g., strength, ductility, stiffness, and abrasion resistance) when used at elevated temperatures as high as 500° C.

These and other objects are basically accomplished by mixing the acrylic polymer with a carboxylic acid so that the polymer fiber is permeated therewith, the acid being one which, upon heating the fiber to an oxidizing temperature, will form the anhydride corresponding to that acid (and it is postulated that the anhydride will equilibrate within the fiber with the acid); oxidizing the treated fibers in an oxidizing atmosphere; and stretching the fibers during the oxidation process. The acid and/or its anhydride appears to act as a plasticizer, or form a plasticizer by reaction with the polymer or with the oxidation products of the polymer, reducing fiber yield stress and increasing fiber plasticity such that the treated fibers may be drawn, during oxidation, to a length at least doubled, hence well beyond the prior art limit of elongation as heretofore noted, and as much as quadruple the original length. The carboxylic acid should be present in the fiber, during oxidation, in a quantity to improve the stretchability to the extent noted above. The relative amount of acid used depends then upon such factors as the nature of the acid, the choice of the particular fiber as to constituents and diameter, the length of time allowed to permit the acid to permeate the fiber to some desired extent, etc., and can easily be determined empirically for each set of parameters.

It is well known that the addition of carboxylic acids to PAN fibers promotes stabilization of the fibers, apparently due to catalyzation of the cyclization reaction. Cf. U.S. Pat. No. 4,002,426 and U.K Pat. No. 1,375,136. It has not been appreciated, however, that such acids (specifically omitting formic acid as will be hereinafter noted) for reasons not fully understood, also impart an unexpected stretchability to the PAN fibers during oxidation.

Other objects of the invention will in part be obvious and will in part appear hereinafter. The invention accordingly comprises the processes involving the several steps and the relation and order of one or more of such steps possessing the features, properties and relation of elements which are exemplified in the following detailed disclosure and the scope of the application all of which will be indicated in the claims.

Figure 2:
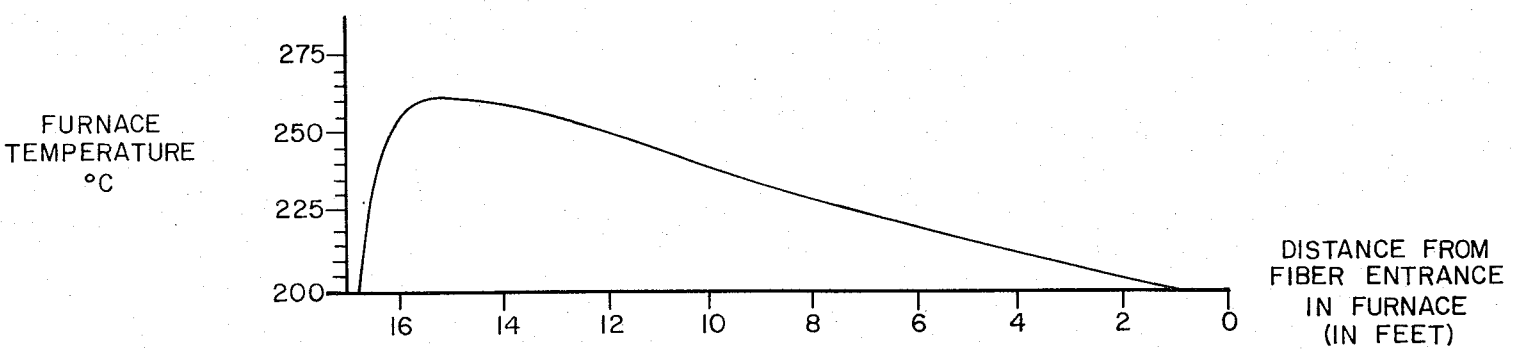

For a fuller understanding of the nature and objects of the present invention, reference should be had to the following detailed description taken in connection with the accompanying drawing wherein:

FIG. 1 is a schematic of the apparatus used to carry out one embodiment of the present invention; and FIG. 2 is a representation of a typical temperature gradient of an oxidation furnace employed in one embodiment of the instant invention.

Referring now to FIG. 1, PAN fibers in the form of a multifilament sheet, tow or web, 20, are pulled from fiber supply spool, 22, by constant speed device, 24, which comprises a pair of electric drive rollers, 25 and 26. Tensioning device 28 of known type, typically comprising three rollers, 29, 30, and 31, in conjunction with take-up device 32, is intended to place the multifilament sheet, tow or web in sufficient uniform tension to draw the PAN fibers to the extent desired during oxidation. The fiber tow 20 is then transferred under tension through an oxidation chamber, such as multizone gradient furnace 34, so as to provide a proper residence time, as discussed below. Upon leaving furnace 34, the oxidized and stretched PAN fiber of tow 20 is taken up on known constant speed take-up device 32, before being passed to a carbonizing zone for further treatment.

It is preferable during the oxidation process to stretch the PAN fibers beyond the maximum prior art limit of elongation during oxidation as achieved by Watt, supra, (i.e. ca. 95%) and as much as quadruple, (i.e. by 300% or more beyond that prior art limit), since the greater the stretching accomplished, the more one will achieve the purposes of the invention to produce higher strength and modulus fibers.

During subsequent carbonization by well-known techniques, the oxidized PAN fibers or filaments are heated in a nonoxidizing atmosphere, such as nitrogen, argon, helium or hydrogen, to temperatures of about 300° C. to about 800° C. The strength and modulus of the oxidized fibers increases rapidly during this stage as carbon dioxide, water, carbon monoxide, HCN, $NH_3$, and other products are released and aromatic ring structures of carbon are formed. The carbonized fibers may then be further heated and graphitized under an inert gas at temperatures up to about 3000° C. Both carbonization and graphitization may be carried out in one or more stages, during which the fibers are generally placed under some tension. Further details of such treatment are not believed to be required herein, since such are well known in the prior art as illustrated by Moss et al in U.S. Pat. No. 4,100,004 and Gump et al in U.S. Pat. No. 3,729,549.

Multizone gradient furnace 34 comprises a number of heating zones, preferably ranging in temperature from a low of about 200° C. to a high of about 260° C., but varying from as much as 180° C. at the entrance to 300° C. at the exit of the furnace. A typical temperature gradient is depicted in FIG. 2 in terms of temperature of the furnace atmosphere at a given distance from the furnace entrance. Of course, a series of separate furnaces with one or more heating zones may be employed to establish a series of temperature stages. Likewise, a single heating zone furnace held at a particular temperature may also be appropriate, depending upon the ultimate properties desired in the fiber product.

An oxygenation medium comprising oxygen and oxygen-containing gases such as air, nitrous oxide and sulphur dioxide is supplied to furnace 34 by line 36. Although only shown as supplied at the inlet of furnace 34, the oxygenation medium may be injected into the furnace at various points along the path of the fibers as they are oxidized.

Pressure relief and recirculation of the oxidation reaction and thermal decomposition products of PAN, as well as any unreacted gases, can be achieved by venting furnace 34 through line 38, although it may be desirable to permit the gases in the furnace to remain relatively stagnant to encourage the postulated equilibrium between the vaporized acid and its anyhydride in the fiber. A main component of these decomposition products is HCN, particularly during oxidation of the fibers. However, other components include CO, $CO_2$, $H_2O$, $NH_3$, as well as a number of intermediate hydrocarbons and nitriles, including acetonitrile and acrylonitrile.

In accordance with the present invention, a carboxylic acid is mixed with the PAN fiber. At the temperatures used to oxidize the fiber or filament, this carboxylic acid will substantially vaporize and convert to the corresponding anhydride with which the acid can be in material equilibrium, at least in part, in the fiber. Inasmuch as such temperatures are in the range of about 180° C. to about 300° C., it is apparent that formic acid is excluded inasmuch as it decomposes at such temperatures and does not form an anhydride. Other carboxylic acids may not vaporize at such temperatures or may not thermally form their anhydride in sufficient amounts to maintain a substantially balanced equilibrium, i.e. the reaction goes virtually to completion in one direction or the other. Thus, both mono- and polycarboxylic acids are useful. Typically, such diverse carboxylic acids as acetic acid and itaconic acid are acceptable for purposes of the invention. Mixing of the fiber and acid can occur in the original manufacturing process for the fiber, or the fiber can be permeated or impregnated with the carboxylic acid by imbibition in an appropriate solution of the acid. The imbibition time to impregnate the fiber depends upon the composition of the fiber, particularly the nature of the interstitial voids provided by the introduction of copolymers and other materials into the original fiber. Typically, imbibition times of from one half minute to several hours can be used, but the longer imbibition times seem to provide the better results.

The plasticizing action of the carboxylic acid and/or its anhydride is believed to facilitate molecular motion in the PAN filaments. In any event, some acids may be less readily absorbed in the PAN filaments than others, depending upon the steric aspects of the acid and the molecular structure of the particular filament. Thus, care must be taken to insure proper mixture of filament polymer and concentration of the acid, both in amount and in time as the case may be, to allow absorption of the latter into the acrylic filaments. Homopolymer acrylonitrile exhibits little, if any, permeation by carboxylic acids from a soaking bath, even over extended periods of time, so the desired acid should preferably be incorporated into the filament at the time of spinning.

In accordance with the present invention, filament residence time in the furnace should generally not be less than one-half minute, and is preferably in the range from one-half minute to 120 minutes, since the plasticizing effect is not immediate. Consequently, oxidizing the filaments slowly is favored.

In this regard, the acrylic polymer which is utilized in the present process is formed either entirely of recurring acrylonitrile units, or of recurring acrylonitrile units copolymerized with a minor proportion of one or more vinyl units to produce a copolymer exhibiting properties substantially similar to an acrylonitrile homopolymer, particularly with regard to the time needed to undergo oxidation. As to the temperature used in the oxidation process, while acrylonitrile homopolymers can be used in the present process, other PAN copolymer filaments which oxidize over a wide temperature range are preferred.

In the prior art as exemplified by Watt, supra, the acrylic filaments were stretched, if at all, during oxidation by approximately not more than 95% their original length. In contrast, the treatment of the filaments with carboxylic acid in accordance with the present invention allows the treated acrylic filaments to be stretched during oxidation, as much as 300% or more compared to the untreated fiber, thus increasing the ultimate strength and modulus of the resulting carbon filaments by as much as 40% and 50%, respectively, or more. The increase in the strength and modulus of the carbon fiber produced from such oxidized PAN filaments is believed to occur because improved extension of the filaments causes greater polymer ladder chain orientation than has been heretofore possible. The increased surface area-to-volume ratio substantially improves the capability of the filaments to be bonded to a matrix material in a composite, a primary use of such filaments.

As readily appreciated by those skilled in the art, these improved properties are obtained at little or no increase in cost, since the plasticizing effect may be obtained by simple addition of inexpensive carboxylic acids to the fiber. Additionally, overall energy requirements to produce a given strength or modulus of oxidized or carbonized PAN fiber are reduced, since the fibers obtain greater strength and modulus at an earlier stage of the process, thus reducing the number of stages and the extent of heating required. Concomitant equipment savings are likewise obvious to those skilled in the art.

Use of the carboxylic acid and/or its anhydride at the oxidizing temperatures as a plasticizing medium also allows smaller diameter oxidized PAN and carbon fibers to be produced than previously possible. Commercial prior art processes used precursor fibers of at least approximately 1.0 denier, or greater, produced oxidized PAN fibers of 11 microns or larger in diameter and produced by drawing of the oxidized PAN, carbon fibers of 6 microns or more in diameter. In contrast, the present invention produces oxidized PAN fibers of less than 10 microns in diameter (average), permitting formation of carbonized fibers as small as as 2 microns in diameter (average), with substantial increases in fiber properties.

The following examples further illustrate the invention and the advantages resulting therefrom. These examples are presented solely for illustration, such that the invention should not be construed as being limited to the particular conditions set forth in the examples.

EXAMPLE I

E. I. DuPont Orlon brand fiber is a commercially available PAN fiber with copolymer units interspersed throughout the fiber structure. On information and belief, the composition of the fiber is 94% polyacrylonitrile and 6% methyl acrylate. A thermal gradient from 220° C. to 240° C. was established in furnace 34 in several steps. Pure oxygen served as the oxygenation medium supplied through line 36. The drawn and oxidized PAN fiber, untreated with any acid, exhibited a maximum draw ratio of 1.27, corresponding to a 27% elongation, a typical example of the usual prior art elongation.

EXAMPLE II

Courtauld's SAF Courtelle fiber (hereinafter referred to as SAF) is a commercially available PAN fiber with copolymer units interspersed throughout the fiber structure. This fiber is believed to differ from the DuPont Orlon brand of acrylic fiber used in Example I in that, the manufacturer's information indicates that the composition of the Courtelle fiber is 93% polyacrylonitrile, 6% methyl acrylate and 1% itaconic acid. An SAF 3000 fiber tow of 1.2 d'tex of this Courtelle fiber was drawn in three stages to 300% during oxidation with a residence time of about 1 hour. A thermal gradient from 220° C. to 260° C. was established in furnace 34 in three steps of 10 to 20 degrees Celsius each (i.e. 220°-230° C., 230°-240° C., 240°-260° C.). Pure oxygen served as the oxygenation medium supplied through line 36. The maximum draw ratio was 3.08, resulting in a 208% elongation at the end of the first oxidation stage, a considerable improvement over the similar DuPont fiber which was untreated with carboxylic acid prior to or during elongation.

Four tows of the stretched fiber were collimated to make one 12,000 fiber tow during the last step of the oxidation process. The drawn and oxidized PAN fiber was then carbonized continuously between 300° C. and 800° C. under nitrogen, and thereafter graphitized under nitrogen at 1400° C. and at 2300° C. in two steps. The graphite fiber diameter was found to be approximately 3 microns and a tensile strength of $51\times10^4$ psi and tensile modulus of $64\times10^6$ psi were observed. This represents a 46% increase in tensile strength and a 52% increase in the modulus, since a graphitized fiber prepared from the same precursor PAN under identical conditions, but without drawing during oxidation, had a diameter of approximately 7 microns with a tensile strength of $35\times10^4$ psi and a tensile modulus of $50\times10^6$ psi.

EXAMPLE III

Example II was repeated, but prior to oxidizing the PAN fiber, the latter was soaked for one minute in a 6% itaconic acid solution in a dip tank, then put through squeeze rolls to express excess fluid, and placed into the oxidizing chamber. On drawing the fiber during the first stage of oxidation, a draw ratio of 3.61 was obtained.

EXAMPLE IV

Example II was repeated three times, but in each case the PAN fiber was soaked in water only. Upon drawing the fiber during the first stage of oxidation, respective draw ratios of 3.03, 3.03 and 3.17 were observed, in excellent agreement with the results of Example III.

EXAMPLE V

Example III was repeated, using 10% acetic acid solution as the dip. On fiber drawing, the observed maximum draw ratio was 3.60.

EXAMPLE VI

Example III was repeated, using a 1% acetic acid solution as the dip. A draw ratio of 3.37 was obtained upon drawing the fiber.

EXAMPLE VII

Example II was repeated with however the following changes:

The fiber tow was drawn to three times its original length during oxidation in two stages in the furnace using thermal gradients of 220° C. to 240° C. and 230° C. to 250° C. Air was used as the oxidation medium. The drawn and oxided PAN fiber was carbonized continuously at 300° C. to 800° C. under nitrogen and thereafter graphitized under nitrogen at 1400° C. The graphite fiber thus formed had a diameter of about 3.8 microns average, a tensile strength of $64.2\times10^4$ psi and a modulus of $35\times10^6$ psi, a considerable increase in strength over even the improved fibers of Example II, with some diminution of modulus.

EXAMPLE VIII

Carbon-fiber quality PAN sold by Mitsubishi was used in the process of the present invention, the fiber tow having a 1.44 d'tex. This fiber is beleived to be a copolymer of polyacrylonitrile with less than 15% methyl acrylate. The fiber tow was dipped into an aqueous 6% itaconic acid solution for one minute and then oxidized in air at 243° C. The tow was drawn during oxidation to a maximum draw ratio of 2.24.

EXAMPLE IX

Example VIII was repeated but oxidation was carried on at 255° C. During oxidation, the fiber tow exhibited a draw ratio of 3.21.

Although the invention has been described with preferred embodiments, it is to be understood that variations and modifications may be resorted to as will be apparent to those skilled in the art. Such variations and modifications are to be considered within the purview and scope of the following claims.

What is claimed is:

1. In a method of oxidizing fibers of an acrylic polymer comprising recurring acrylonitrile units, wherein said fibers are oxidized in an oxidizing atmosphere heated to a temperature range between about 180° C. to about 300° C. preparatory to carbonization of said fibers, and during oxidation said fibers are drawn under tension, the improvement comprising the steps of permeating said polymer with a carboxylic acid capable of forming its anhydride when heated to within said temperature range, and drawing said permeated fibers under tension during oxidation of said fibers in said atmosphere within said temperature range, said carboxylic acid being present initially in said polymer in an amount sufficient to permit improved drawing of the fiber to at least double the original fiber length, and to an average fiber diameter of less than 10 microns.

2. A process according to claim 1 wherein said polymer is acrylonitrile homopolymer.

3. A process according to claim 3 wherein said polymer is an acrylonitrile polymer containing at least about 85 mole percent of acrylonitrile units copolymerized with at least another material.

4. A process according to claim 1 wherein said acid is a monocarboxylic acid.

5. A process according to claim 1 wherein said acid is a dicarboxylic acid.

6. A process according to claim 1 wherein said acid is selected from the group consisting of acetic and itaconic acids.

7. A process according to claim 1 wherein said fiber is maintained in said atmosphere for a period of between about ½ to 120 minutes.

8. A process according to claim 1 including the step of establishing a temperature gradient along said fibers from about 220° C. to about 260° C. during said oxidation.

9. A process according to claim 1 wherein said drawing of the fibers is in excess of double the original length of said fibers.

10. A process according to claim 1 including the step of treating the fiber with said acid in a soaking bath before disposing said fibers within said oxygen-containing atmosphere.

11. A process according to claim 1 wherein said acid is incorporated in said fibers during or prior to the original formation of the latter.

12. A process of producing a carbonized fiber which, during oxidation, is drawn beyond the prior limit of elongation of about 95%, said process comprising the steps of:

a. supplying an oxygen-containing atmosphere to a multizone gradient furnace;

b. heating said furnace so as to maintain a temperature gradient in said atmosphere from about 220° C. at the inlet of said furnace to about 260° C. at the outlet thereof;

c. permeating a multifilament tow of fibers formed of a polyacrylonitrile copolymer which contains about 85 mole percent acrylonitrile units and about 15 mole percent methyl acrylate, with sufficient carboxylic acid to permit subsequent drawing of said fibers during oxidation to at least double its original length;

d. passing the multifilament permeated tow of fibers through said atmosphere along said temperature gradient in said furnace, with a residence time of between about ½ and 120 minutes;

e. tensioning said multifilament permeated tow of fibers during passage through said atmosphere along said temperature gradient so as to draw the fibers to at least double its original length; and f. thereafter passing the multifilament tow through a second multizone gradient furnace with a temperature gradient of about 300° C. at the inlet thereof to about 800° C. at the outlet thereof.

13. A graphitized fiber produced from an oxidized polyacrylonitrile precursor fiber and having a tensile strength of approximately $51\times10^4$ psi, and a modulus of approximately $64\times10^6$ psi and a diameter of about 4.5 microns or less.

14. A graphitized fiber produced from an oxidized polyacrylonitrile precursor fiber permeated with a carboxylic acid prior to oxidation, said fiber having been drawn under tension during oxidation to an elongation of more than double the original length of the fiber and to an average diameter of less than 10 microns, said graphitized fiber having a tensile strength of approximately $64\times10^4$ psi, a modulus of approximately $35\times10^6$ psi and a diameter of about 4.5 microns or less.

* * * * *

UNITED STATES PATENT AND TRADEMARK OFFICE

CERTIFICATE OF CORRECTION

PATENT NO. : 4,526,770

DATED : July 2, 1985

INVENTOR(S) : Roger T. Pepper et al

It is certified that error appears in the above-identified patent and that said Letters Patent is hereby corrected as shown below:

Claim 3, column 9, line 67, change "3" to -- 1 --.

Signed and Sealed this

*Twenty-ninth* Day of *October 1985*

[SEAL]

*Attest:*

*Attesting Officer*

DONALD J. QUIGG

*Commissioner of Patents and Trademarks—Designate*